US012240686B2

(12) United States Patent
Park

(10) Patent No.: US 12,240,686 B2
(45) Date of Patent: Mar. 4, 2025

(54) CASSETTE FOR ACCOMMODATING GLASS, METHOD FOR LOADING GLASS INTO CASSETTE, AND METHOD FOR MANUFACTURING COVER WINDOW

(71) Applicant: Samsung Display Co., Ltd., Yongin-Si (KR)

(72) Inventor: Sunkyun Park, Yongin-si (KR)

(73) Assignee: Samsung Display Co., Ltd., Yongin-Si (KR)

( * ) Notice: Subject to any disclaimer, the term of this patent is extended or adjusted under 35 U.S.C. 154(b) by 0 days.

(21) Appl. No.: 17/735,372

(22) Filed: May 3, 2022

(65) Prior Publication Data

US 2023/0062692 A1 Mar. 2, 2023

(30) Foreign Application Priority Data

Aug. 26, 2021 (KR) ..... 10-2021-0113396

(51) Int. Cl.
*B65D 90/00* (2006.01)
*B65D 85/48* (2006.01)

(52) U.S. Cl.
CPC ..... *B65D 90/0086* (2013.01); *B65D 85/48* (2013.01); *B65D 90/0073* (2013.01); *B65D 2585/30* (2013.01); *B65D 2590/547* (2013.01); *B65D 2590/664* (2013.01)

(58) Field of Classification Search
CPC ..... B65D 2590/54; B65D 2590/545; B65D 85/48; B65D 90/0086; B65D 90/0046; B65D 90/004; E05B 83/12
USPC ..... 206/711, 454; 220/211
See application file for complete search history.

(56) References Cited

U.S. PATENT DOCUMENTS

| | | | | |
|---|---|---|---|---|
| 3,438,530 | A * | 4/1969 | Wallace | B65D 41/0407 215/44 |
| 5,883,806 | A * | 3/1999 | Meador | G07F 17/0092 221/99 |
| 8,342,327 | B1 | 1/2013 | Nam et al. | |
| 9,566,128 | B2 * | 2/2017 | Erickson | A61B 50/3001 |
| 9,637,281 | B2 | 5/2017 | Koo | |
| 11,594,439 | B2 * | 2/2023 | Schneider | H01L 21/67389 |
| 2007/0160801 | A1 * | 7/2007 | Johnstone | B01D 5/0066 428/98 |
| 2008/0047917 | A1 * | 2/2008 | Hernandez | B65D 90/0073 211/180 |

FOREIGN PATENT DOCUMENTS

| | | | |
|---|---|---|---|
| KR | 10-2007-0021733 | A | 2/2007 |
| KR | 10-2013-0005880 | A | 1/2013 |
| KR | 10-1348305 | B1 | 1/2014 |
| KR | 10-1610643 | A | 4/2016 |

* cited by examiner

*Primary Examiner* — Anthony D Stashick
*Assistant Examiner* — Raven Collins
(74) *Attorney, Agent, or Firm* — Innovation Counsel LLP

(57) ABSTRACT

A cassette for accommodating glass includes: a cassette main body for accommodating a plurality of glasses; a housing arranged on at least one side of the cassette main body and including a plurality of openings arranged side by side in one direction; and a plurality of doors configured to open and close the plurality of openings.

8 Claims, 18 Drawing Sheets

CASSETTE FOR ACCOMMODATING GLASS, METHOD FOR LOADING GLASS INTO CASSETTE, AND METHOD FOR MANUFACTURING COVER WINDOW

CROSS-REFERENCE TO RELATED APPLICATION

This application is based on and claims priority under 35 U.S.C. § 119 to Korean Patent Application No. 10-2021-0113396, filed on Aug. 26, 2021, in the Korean Intellectual Property Office, the disclosure of which is incorporated by reference herein in its entirety.

BACKGROUND

1. Field

One or more embodiments relate to a cassette for accommodating glass, a method of loading glass in a cassette, and a method of manufacturing a cover window, and more particularly, to a cassette for accommodating glass that prevents inflow of external foreign materials, a method of loading glass into a cassette, and a method of manufacturing a cover window.

2. Description of the Related Art

Generally, organic light-emitting display apparatuses, flat display apparatuses including a liquid crystal display (LCD), or curved display apparatuses are manufactured by using a large-sized mother glass in a manufacturing process.

During a display apparatus manufacturing process, a cassette for accommodating glasses is used to carry a plurality of mother glasses or store a plurality of mother glasses. The cassette for accommodating glass provides a space for stacking glass such as a plurality of mother glasses during the manufacturing process.

Generally, in a clean-room used for manufacturing flat display apparatuses, even though facilities for air cleaning are secured in the clean-room, foreign materials floating inside the clean-room may frequently enter into an inner space of an open cassette and adhere to a surface of a mother glass while a cassette for accommodating glass is carried and stored. Accordingly, deterioration of the quality of flat display apparatuses is expected. Accordingly, the inside of a cassette for accommodating glass needs to be sealed.

The above background art is technical information possessed by the inventor to derive the present disclosure or obtained during a process of deriving the present disclosure, and is not necessarily considered to be a known art open to the general public prior to the filing of the present disclosure.

SUMMARY

To seal the inside of a cassette for accommodating glass, various methods may be used. Generally, it is difficult to open/close a door attached/detached to/from a cassette. While the door is attached/detached, foreign materials may be introduced.

One or more embodiments include a cassette for accommodating glass that may be easily opened/closed without detachment/attachment of a door of a cassette and which may prevent inflow of foreign materials, and a method of manufacturing a cover window using the cassette.

However, such a technical problem is an example, and the disclosure is not limited thereto.

Additional aspects will be set forth in part in the description which follows and, in part, will be apparent from the description, or may be learned by practice of the presented embodiments of the disclosure.

According to one or more embodiments, a cassette for accommodating glass includes a cassette main body for accommodating a plurality of glasses, a housing arranged on at least one side of the cassette main body and including a plurality of openings arranged side by side in one direction, and a plurality of doors configured to open and close the plurality of openings.

Each of the plurality of doors may be configured to selectively expose each of the plurality of openings to the outside such that each of the plurality of glasses is loaded into the cassette.

The door may be opened or closed by rotating around a rotational axis.

The door may be opened by rotating the door in a direction facing the outside of the cassette main body.

The door may include a curved surface, and the housing may include a concave curved surface corresponding to a portion of the curved surface.

A contact surface between the door and the housing may have a slope.

A surface of the door facing the outside of the cassette main body may be greater than a surface of the door facing an inside of the cassette main body.

The door may rotate within an angle of a preset range.

The cassette for accommodating glass may further include a driver arranged on at least one side of the housing and configured to control opening of each of the plurality of doors.

The plurality of doors may each include a groove portion in one side thereof, and the driver may include a rotation pin coupled to the groove portion and rotating the door to open and close the door.

According to one or more embodiments, a method of loading glass into a cassette includes selectively opening each of a plurality of doors connected to a housing arranged on one side of the cassette, loading glass into the cassette through the opened door, and closing the opened door after the glass is loaded.

The door may be opened and closed by rotating a rotational axis.

The door may include a sloped surface, and the housing may include a sloped surface corresponding to the sloped surface of the door.

Rotation of the door may be stopped when the sloped surface of the door contacts the sloped surface of the housing.

The method may further include controlling, by a driver, opening of each of the plurality of doors, the driver being arranged on at least one side of the housing.

According to one or more embodiments, a method of manufacturing a cover window includes selectively opening each of a plurality of doors connected to a housing arranged on one side of the cassette, accommodating a plurality of glasses in a cassette through the plurality of doors, closing the plurality of doors, moving the cassette to a cover window manufacturing stage, and manufacturing a cover window.

The accommodating of the plurality of glasses may include accommodating each of the plurality of glasses through each of the plurality of doors corresponding to the plurality of glasses.

The plurality of doors may be opened and closed by rotating a rotational axis.

Rotation of the plurality of doors may be stopped when the plurality of doors contacts a sloped surface of the housing.

The method of manufacturing a cover window may further include controlling, by a driver, opening of each of the plurality of doors, the driver being arranged on at least one side of the housing.

These and/or other aspects will become apparent and more readily appreciated from the following description of the embodiments, the accompanying drawings, and claims.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1:
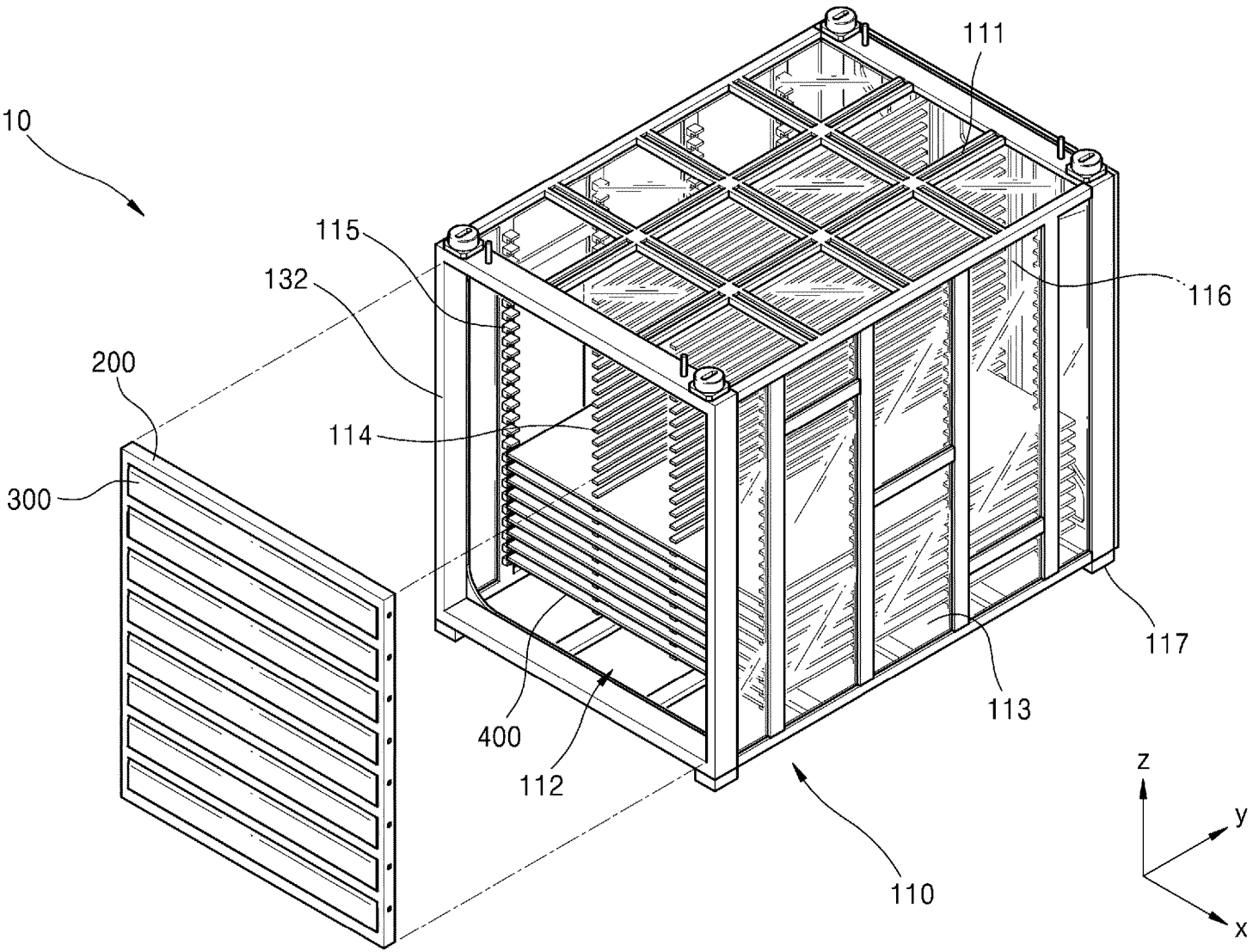
FIG. 1 is a separated perspective view of a cassette for accommodating glass according to an embodiment.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Throughout the disclosure, the expression "at least one of a, b or c" indicates only a, only b, only c, both a and b, both a and c, both b and c, all of a, b, and c, or variations thereof.

As the present disclosure allows for various changes and numerous embodiments, certain embodiments will be illustrated in the drawings and described in the written description. Effects and features of the disclosure, and methods for achieving them will be clarified with reference to embodiments described below in detail with reference to the drawings. However, the disclosure is not limited to the following embodiments and may be embodied in various forms.

Hereinafter, embodiments of the present disclosure are described in detail with reference to the accompanying drawings. When description is made with reference to the drawings, like reference numerals are used for like or corresponding elements and repeated descriptions thereof are omitted.

While such terms as "first" and "second" may be used to describe various components, such components must not be limited to the above terms. The above terms are used to distinguish one component from another.

The singular forms "a," "an," and "the" as used herein are intended to include the plural forms as well unless the context clearly indicates otherwise.

It will be understood that the terms "comprise," "comprising," "include" and/or "including" as used herein specify the presence of stated features or components but do not preclude the addition of one or more other features or components.

It will be further understood that, when a layer, region, or component is referred to as being "on" another layer, region, or component, it can be directly or indirectly on the other layer, region, or component. That is, for example, intervening layers, regions, or components may be present.

Sizes of elements in the drawings may be exaggerated or reduced for convenience of explanation. For example, since sizes and thicknesses of elements in the drawings are arbitrarily illustrated for convenience of explanation, the disclosure is not limited thereto.

The x-axis, the y-axis and the z-axis are not limited to three axes of the rectangular coordinate system, and may be interpreted in a broader sense. For example, the x-axis, the y-axis, and the z-axis may be perpendicular to one another, or may represent different directions that are not perpendicular to one another.

In the case where a certain embodiment may be implemented differently, a specific process order may be performed in the order different from the described order. As an example, two processes that are successively described may be substantially simultaneously performed or performed in the order opposite to the order described.

Hereinafter, a cassette for accommodating glass according to an embodiment is described with reference to the drawings.

Figure 2:
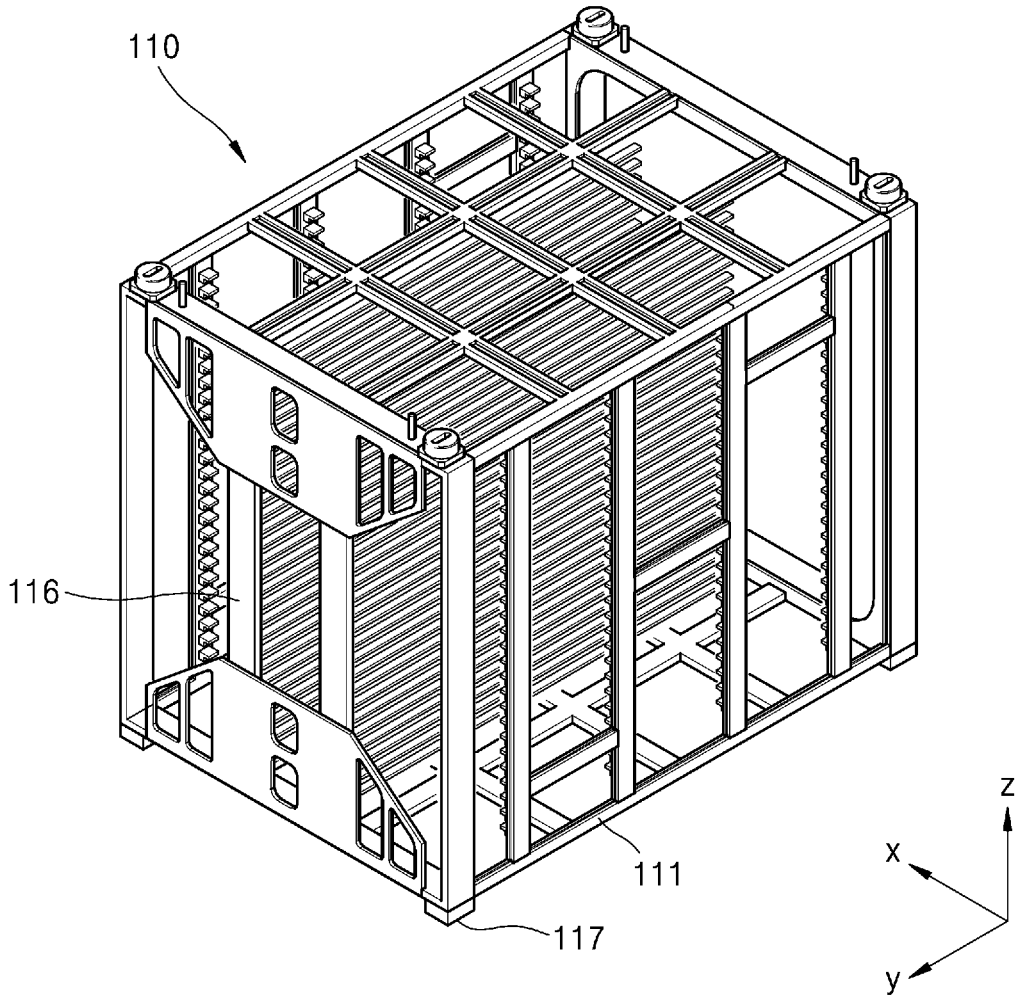
FIG. 2 is a perspective view of an opposite side of a cassette main body from which the cassette for accommodating glass of FIG. 1 is separated.

FIG. 1 is a separated perspective view of a cassette for accommodating glass according to an embodiment, and FIG. 2 is a perspective view of an opposite side of a cassette main body from which the cassette for accommodating glass of FIG. 1 is separated.

Referring to FIGS. 1 and 2, a cassette 10 for accommodating glass may include a cassette main body 110, a housing 200, and a door 300.

The cassette main body 110 may include a plurality of frames 111 connected to each other to form a box-shaped frame. In this case, at least one side of the cassette main body 110 forms an opening hole 112 to provide a path such that a plurality of glasses 400 like mother glasses may be transferred therethrough. The frame 111 may include a metal material having excellent strength.

A cover plate 113 is coupled to the outside of the frame 111. The cover plate 113 may cover openings formed by the box-shaped frame. The cover plate 113 may be installed one by one on each surface of the box-shaped frame or installed in plurality to cover openings formed in each surface of the box-shaped frame having a plurality of openings.

The cover plate 113 may be inserted into grooves formed in the frame 111, or coupled to the front side or backside of the frame 111 through screw coupling and the like. However, the coupling methods are not limited thereto. The cover plate 113 entirely covers the outside of the frame 111 except the opening hole 112. That is, the cover plate 113 may seal each surface of the cassette main body 110 except the opening hole 112. In addition, the cover plate 113 may include a polymer resin such as polycarbonate. In addition, the cover plate 113 may be configured to be transparent and thus the inside may be viewed from outside.

Supporters 114 supporting the glasses 400 are installed inside the cassette main body 110 to support each of the glasses 400 which is stacked in a vertical direction (e.g., a z-direction in FIG. 1). The supporters 114 may prevent a large-sized glass 400 from sagging due to gravity and allow the plurality of glasses 400 to be accommodated separately from each other in the cassette main body 110.

The supporters 114 may be installed from one side of the cassette main body 110 to another side, for example, installed horizontally across a space from the opening hole 112 of the cassette main body 110 to a surface facing the opening hole 112. At least one supporter 114 may be provided in the cassette main body 110. The supporters 114 may be coupled to the frame 111 of the cassette main body 110 by a support member (not shown) separately prepared. The supporter 114 is a strip that may support the backside (e.g., a (−) z-direction in FIG. 1) of the glass 400. The plurality of supporters 114 may be installed to be spaced apart from each other in a vertical direction (e.g., the z-direction in FIG. 1) in the cassette main body 110. In addition, the plurality of supporters 114 may be spaced apart from each other in a horizontal direction (e.g., an x-direction in FIG. 1) of the cassette main body 110, and the plurality of supporters 114 may be spaced apart from each other in the vertical direction (e.g., the z-direction in FIG. 1) and the horizontal direction (e.g., an x-direction in FIG. 1).

Seat portions 115 may be respectively installed to two opposite sides of the cassette main body 110 facing each other. The seat portion 115 has a hooking jaw shape protruding from the frame 111 facing the side of the cassette main body 110 to the inner space of the cassette main body 110. The seat portions 115 support the edges on two opposite sides of the glass 400. The seat portion 115 is arranged on the same horizontal line as the supporter 114.

Accordingly, in the case where the glass 400 is loaded in the inside of the cassette main body 110, one surface, for example, the backside of the glass 400, is supported by the supporter 114 and the seat portions 115. Two opposite edges of the glass 400 are supported by the seat portions 115 and a middle portion of the glass 400 is supported by the supporter 114. Accordingly, each glass 400 is safely arranged in the inner space of the cassette main body 110.

Back stoppers 116 may be installed to a surface of the cassette main body 110 facing the opening hole 112. The back stoppers 116 may be one or more strips installed, for example, in the vertical direction (e.g., the z-direction in FIG. 2). The back stopper 116 is connected to the frame 111 on one side of the cassette main body 110. The back stopper 116 supports the edge disposed on one side (e.g., a y-direction in FIG. 1) of the glass 400.

The back stopper 116 may serve as a stopper such that the glass 400 transferred through the opening hole 112 of the cassette main body 110 no longer progress beyond one side, for example, a side of the cassette main body 110 facing the opening hole 112 in the inner space of the cassette main body 110.

Pads 117 may be installed under (e.g., the (−) z-direction) the frame 111 to absorb shock, for example, external impacts while the cassette main body 110 moves. Alternatively, though not shown, moving members such as wheels may be installed in cooperation with the pads 117 or instead of the pads 117 to move the cassette main body 110, the moving members being installed under (e.g., the (−) z-direction) the frame 111.

Figure 3:
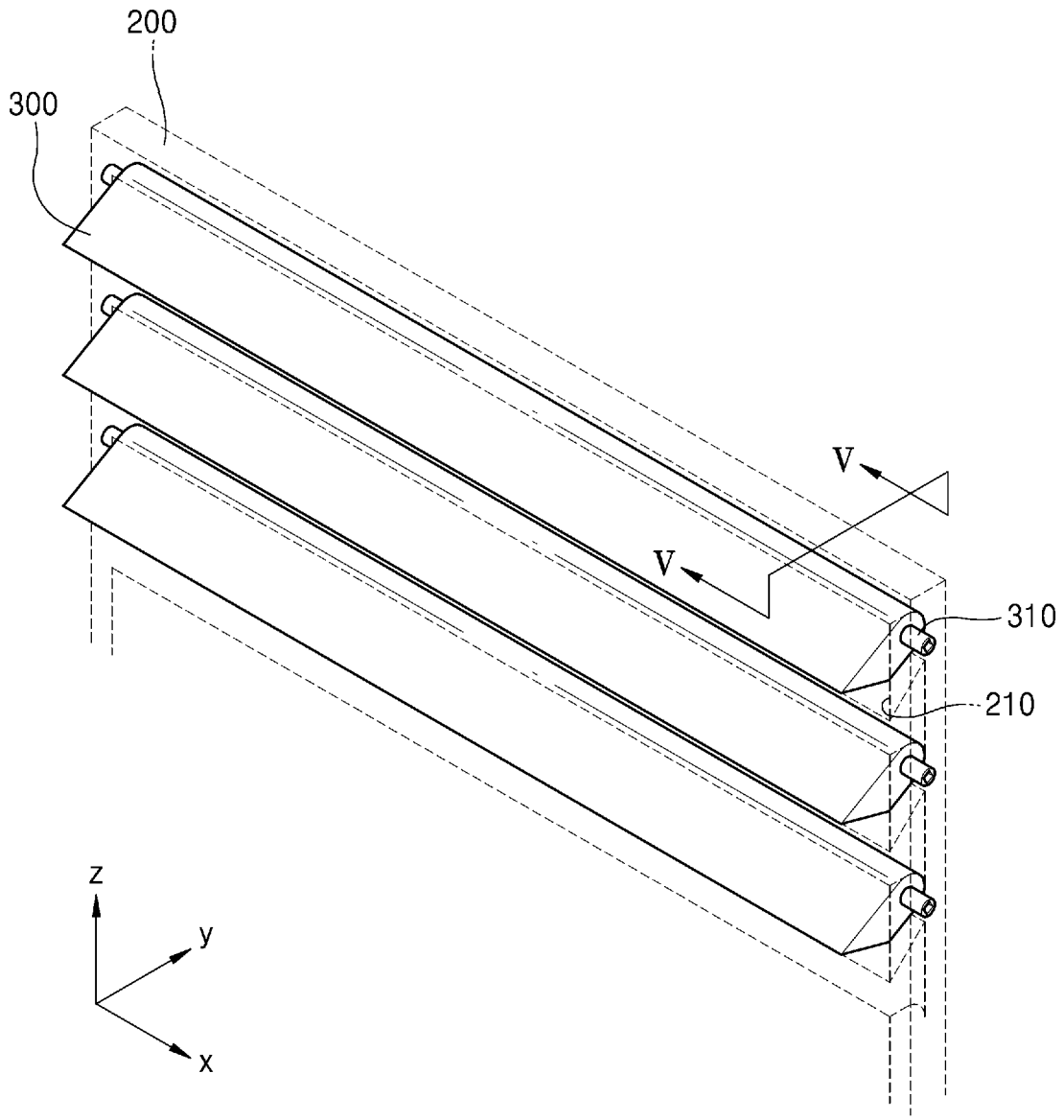
FIG. 3 is a perspective view of a door and a housing of FIG. 1.
Figure 4:
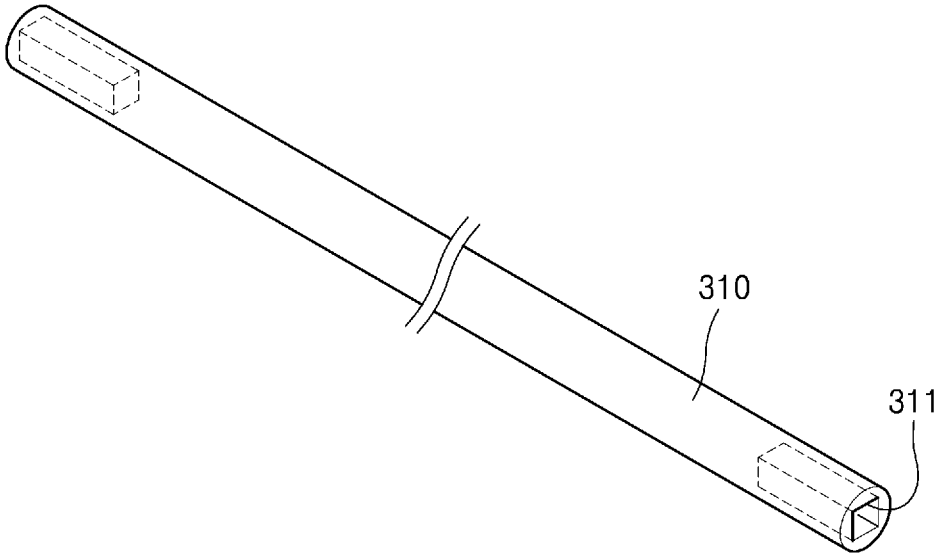
FIG. 4 is a perspective view of a pivot according to an embodiment.

FIG. 3 is a perspective view of the door 300 and the housing 200 of FIG. 1, and FIG. 4 is a perspective view of a pivot according to an embodiment.

Referring to FIG. 3, the housing 200 may be arranged on at least one side of the cassette main body 110. As an example, the housing 200 may be coupled to the cassette main body 110 in which the opening hole 112 is formed. The housing 200 may have a size that may completely cover the opening hole 112. In an embodiment, the housing 200 may be fixed to the cassette main body 110 by using a latch pin (not shown) or fixed by screw coupling. In this case, a contact region between the housing 200 and the cassette main body 110 may be sealed.

The housing 200 may include a plurality of openings 210 arranged side by side in one direction (e.g., the z-direction in FIG. 3). The opening 210 may extend from one side of the housing 200 to another side, for example, in a horizontal direction (the x-direction in FIG. 3). That is, the opening 210 may extend along the same direction as the arrangement direction of the glasses 400 loaded in the cassette main body 110. As an example, in the case where the glass 400 is loaded horizontally, the opening 200 may extend horizontally. In the case where the glass 400 is loaded vertically, the opening 200 may extend vertically. Hereinafter, the case where the glass 400 is loaded horizontally and the opening 210 extends horizontally is mainly described.

As described above, the opening 210 is provided longer than the width (the length in the x-direction in FIG. 3) of the glass 400 to allow the glass 400 to be loaded in the cassette main body 110. In addition, likewise, the vertical width (e.g., the length in the z-direction in FIG. 3) of the opening 210 may be greater than the thickness (the length in the z-direction in FIG. 3) of the glass 400.

In an embodiment, the opening 210 may be provided in a number corresponding to the number of glasses 400 to be loaded in the cassette main body 110. Accordingly, the plurality of glasses 400 may each be inserted to the cassette main body 110 through each opening 210. In addition, each opening 210 may be formed in a position corresponding to a vertical position of each supporter 114. Accordingly, the glass 400 may be horizontally inserted through the opening 210 and seated on the supporter 114.

The door 300 may be arranged in the opening 210 to shield the opening 210 and rotatably connected to the housing 200. The door 300 may be provided in plurality to correspond to the number of openings 210. Because the plurality of doors 300 may be opened and closed individually, the openings 210 through which the plurality of glasses 400 are loaded and unloaded may be opened individually. Accordingly, the inflow of external environmental particles may be prevented by reducing a region that is opened while the glass 400 is loaded and unloaded.

The door 300 may be opened by rotating around a pivot, for example, an axis of rotation, which is connected to the door 300 and the housing 200. In an embodiment, the door 300 may rotate around the pivot extending in the horizontal direction (e.g., the x-direction in FIG. 3). In another embodiment, the door 300 may rotate around a pivot extending in the vertical direction (e.g., the z-direction in FIG. 3). Hereinafter, the case where the door 300 rotates around the pivot extending in the horizontal direction is mainly described.

In an embodiment, a pivot 310 is connected to the door 300. The pivot 310 is an axis of rotation of the door 300 and may pass through the door 300 in the same direction as the axis of rotation. In this case, the pivot 310 may horizontally pass through the upper portion (e.g., a portion in the z-direction in FIG. 3) of the door 300. The door 300 may be opened by rotating upward around the pivot 310 serving as the axis of rotation and passing through the upper portion of the door 300. In addition, the pivot 310 may be exposed to the outside at two opposite sides of the door 300. The pivot 310 may be fixedly coupled to the door 300 and may rotate, thereby rotating the door 300 by the same rotational angle. In this case, the pivot 310 is rotatably coupled to the housing 200 and may rotate in a hole of the housing 200 to which the pivot 310 is inserted.

Referring to FIG. 4, in an embodiment, the pivot 310 may include a groove portion 311. Specifically, the pivot 310 may include a groove portion 311 in each two opposite ends or one end of the pivot 310. A rotational pin 510 of a driver 500 which will be described below may be fit into the groove portion 311. The shape of the groove portion 311 may be a polygon such as a quadrangle and may be formed in an angular shape such as a star shape to enhance coupling force with the driver 500. Hereinafter, the case where the groove portion 311 is formed in a quadrangular shape as shown in FIG. 4 is mainly described.

Figure 5:
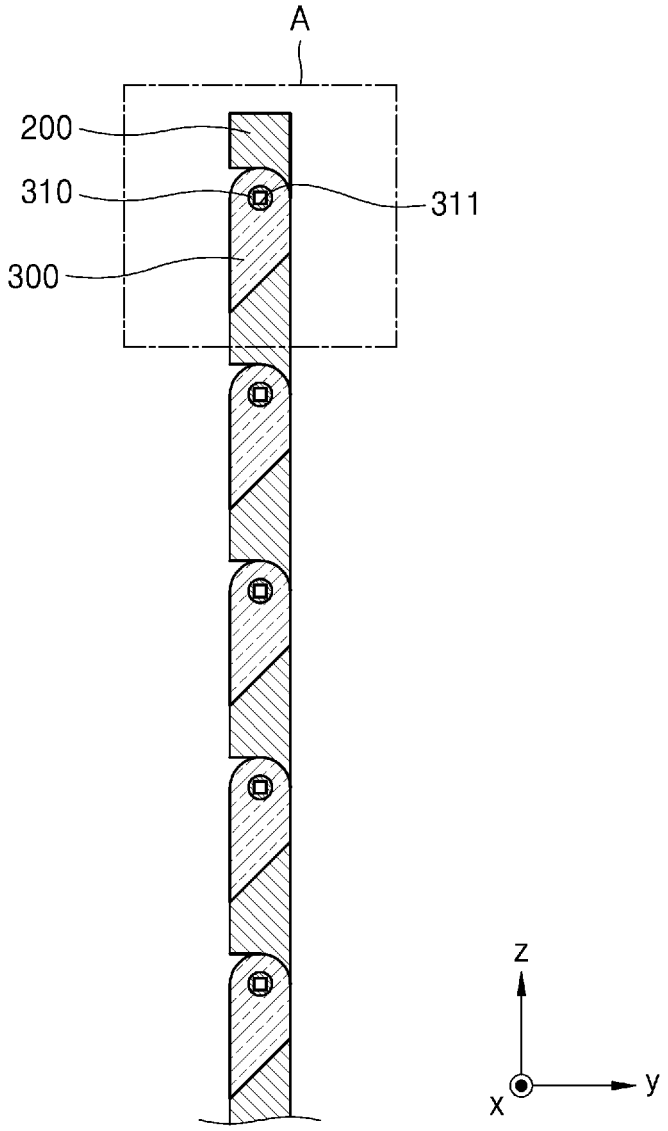
FIG. 5 is a cross-sectional view of a door and a housing of FIG. 3, taken along line V-V.
Figure 6:
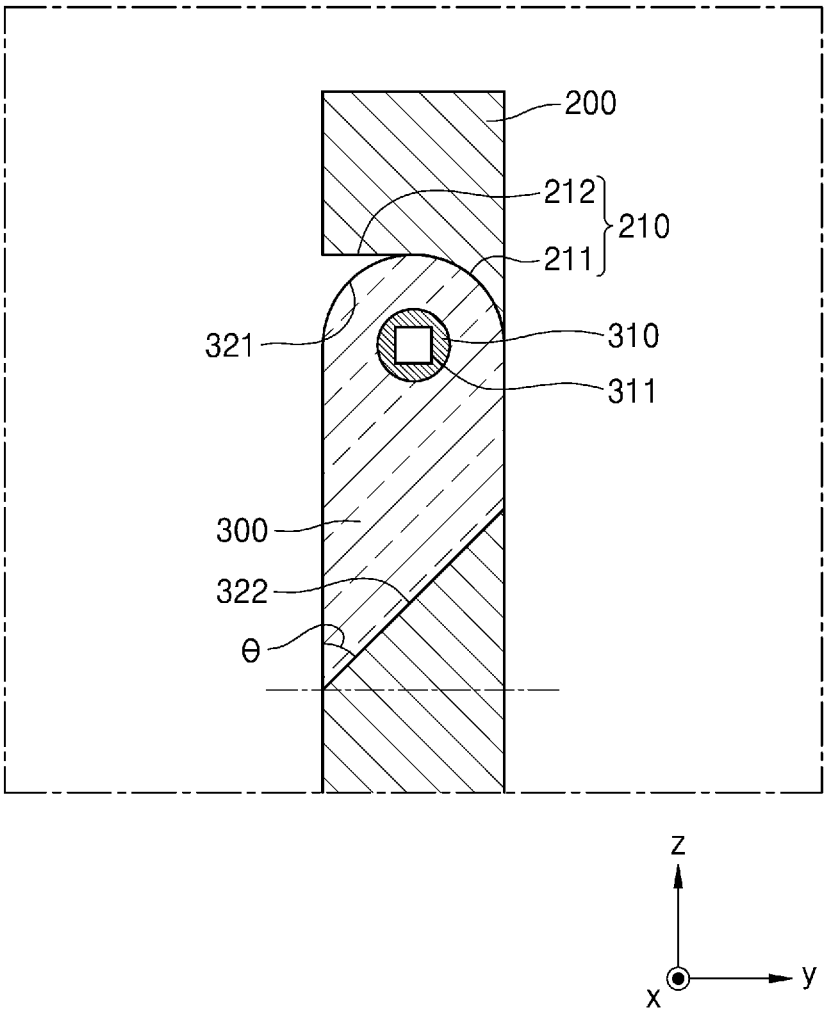
FIG. 6 is an enlarged view of region A of FIG. 5.
Figure 7:
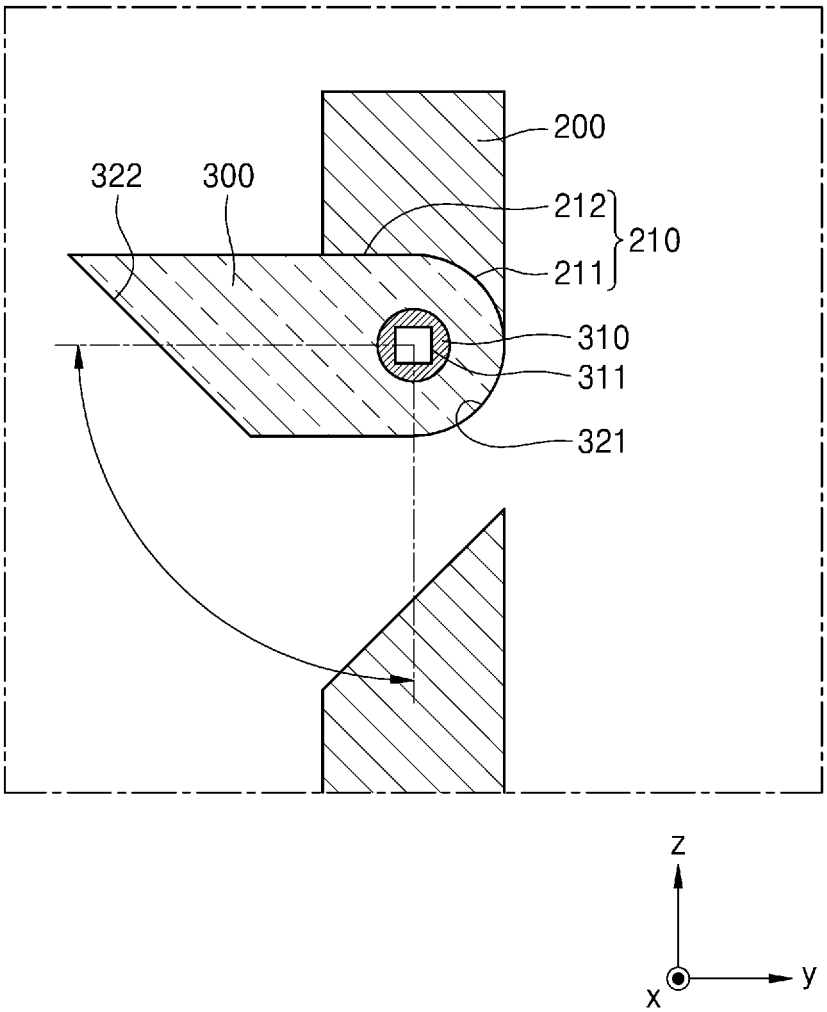
FIG. 7 is a view of the door of FIG. 6 that is being opened.

FIG. 5 is a cross-sectional view of the door 300 and the housing 200 of FIG. 3, taken along line V-V, FIG. 6 is an enlarged view of region A of FIG. 5, and FIG. 7 is a view of the door 300 of FIG. 6 that is being opened.

Referring to FIGS. 5 and 6, two opposite sides of the door 300 may contact the housing 200 in one direction (e.g., the z-direction in FIG. 5). That is, because the door 300 shields the opening 210, the door 300 may contact two opposite sides of the opening 210, for example, the upper portion and the lower portion of the opening 210. A first side 321 denotes one side of the door 300 adjacent to the pivot 310, and a second side 322 denotes another side of the door 300 facing the first side 321, that is, the other side which is spaced apart from the pivot 310 in the height direction (e.g., the z-direction in FIG. 5) of the door 300.

In an embodiment, the first side 321 of the door 300 may include a curved surface. As an example, the lateral cross-section of the first side 321 may have a convex semicircular arc centered on the rotational axis or the pivot 310 as shown in FIG. 6. Though the lateral cross-sectional view of the first side 321 is not limited thereto, hereinafter, for convenience of description, the case where the lateral cross-section of the first side 321 has a semicircular arc is mainly described.

The housing 200 contacting the first side 321, that is, the inner surface of the opening 210, may include a curved portion 211 and a plane portion 212. To accommodate a portion of the curved surface of the first side 321, the curved portion 211 may be formed in a shape corresponding to the outer surface of the curved portion 211. As an example, the lateral cross-section of the curved portion 211 may have a quarter circle shaped portion as shown in FIG. 6. In addition, the curved portion 211 may be formed on the side of the opening 210 facing the cassette main body 110.

The plane portion 212 may be connected to the curved portion 211 and formed on the side of the opening 210 facing the outside of the cassette main body 110.

Accordingly, as the door 300 rotates, the curved portion 211 may accommodate the curved surface of the door 300. In addition, because the curvature of the curved surface of the door 300 is the same as the curvature of the curved portion 211 of the housing 200, the door 300 may smoothly rotate in the opening 210.

In addition, the plane portion 211 may restrict the rotation of the door 300. As shown in FIG. 7, when the door 300 is opened, the rotation of the door 300 is stopped by the plane portion 211 of the housing 200. When one side of the door 300 contacts the plane portion 211 of the housing 200, the door 300 is blocked by the plane portion 212 of the housing 200 not to rotate. As described above, the plane portion 212 may prevent the door 300 from being excessively opened, and thus, prevent external foreign materials from being introduced into the cassette main body 110. In an embodiment, it is shown in FIG. 7 that the plane portion 212 has a plane in a horizontal direction (e.g., a (−) y-direction in FIG. 7). In this case, the door 300 may rotate by about 90° to be fully opened. However, a configuration of the door 300 is not limited thereto, the plane portion 212 may be disposed in a plane formed by the (−y)-direction and the z-direction such that the door 300 further rotates beyond about 90° to be fully opened. Accordingly, the rotation range of the door 300 may be restricted by a simple method.

The door 300 may be opened by rotating the door 300 for the outer side of the door 300 to contact the plane portion 212 of the housing 200 and be closed by rotating the door 300 for the second side 322 of the door 300 contacts the housing 200, specifically, one side of the opening 210.

In an embodiment, the second side 322 may have a sloped surface. In this case, the opening 210 contacting the sloped surface of the door 300 may also include a sloped surface corresponding to the sloped surface of the second side 322. The sloped surface of the second side 322 may close the door 300 by contacting the sloped surface of the opening 210.

In an embodiment, as shown in FIG. 6, an included angle between the second side 322 and the outer surface (the lateral surface facing the outside of the cassette main body 110) of the door 300, and between the inner side of the housing 200 and an inclined portion of the housing 200 may have the same angle θ. That is, the surface of the door 300 facing the outside of the cassette main body 110 may be greater than the surface of the door 300 facing the inside of the cassette main body 110. As an example, as shown in FIG. 6, in the case where the door 300 rotates around the upper portion thereof, the sloped surface of the door 300 may have an upward slope from the outer surface to the inner surface. Accordingly, the door 300 cannot rotate toward the inside of the cassette main body 110 because the inclined portion of the housing 200 blocks the door 300 not to rotate toward the inside of the cassette main body 110, and the door 300 may rotate only toward the outside of the cassette main body 110 to be opened. This may effectively prevent the door 300 and foreign materials from being introduced into the cassette main body 110.

In addition, with airflow around the cassette 10 generally directed from top to bottom, because the sloped surface of the door 300 has the upward slope from the outer surface to the inner surface, the inflow of foreign materials may be suppressed even more.

In an embodiment, for more effective sealing, a sealing member may be arranged on a contact surface between the second side 322 and the inclined portion of the housing 200. The sealing member may be sealant including rubber as an example.

Figure 8:
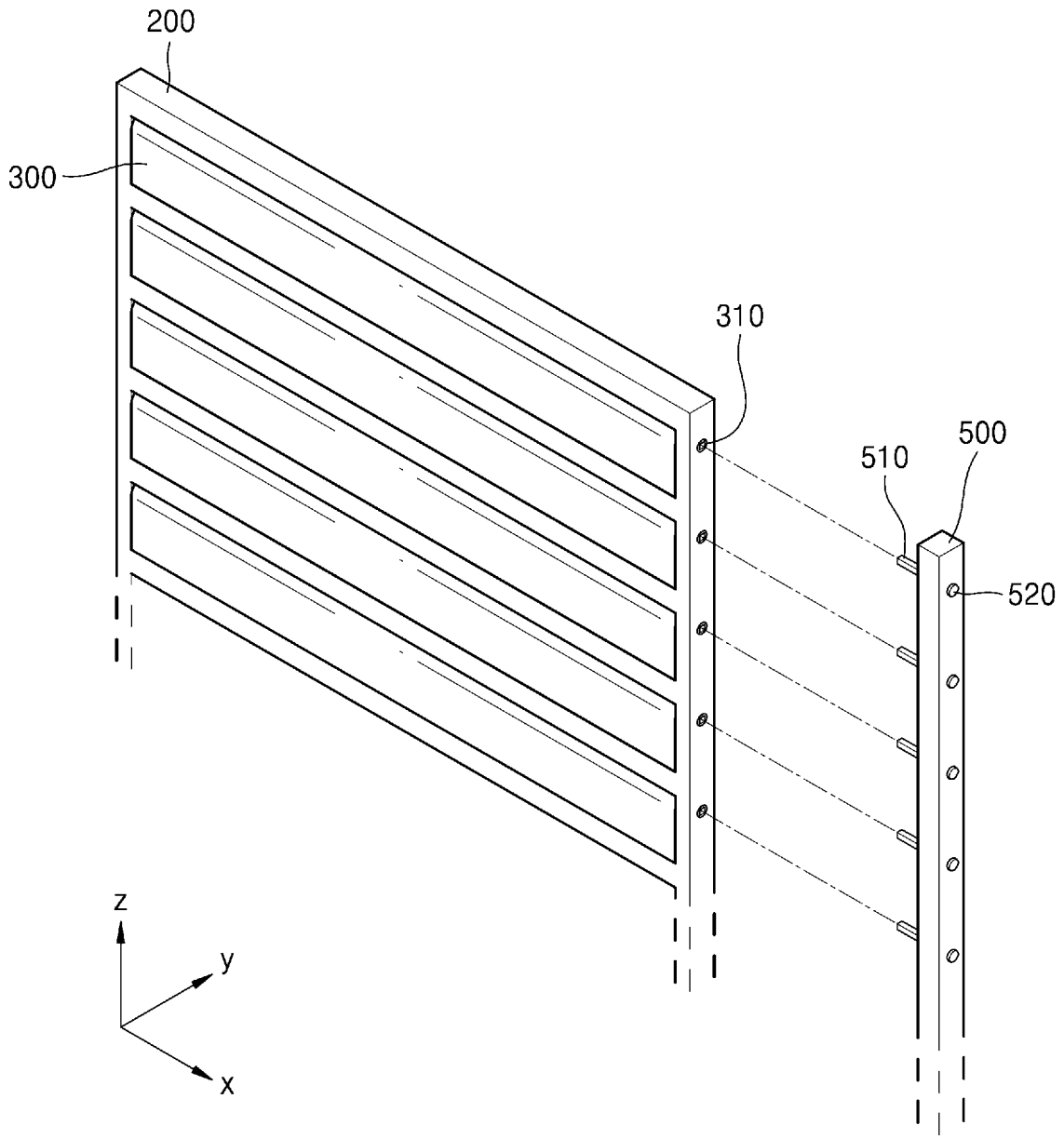
FIG. 8 is a perspective view of a door and a driver according to an embodiment.
Figure 9:
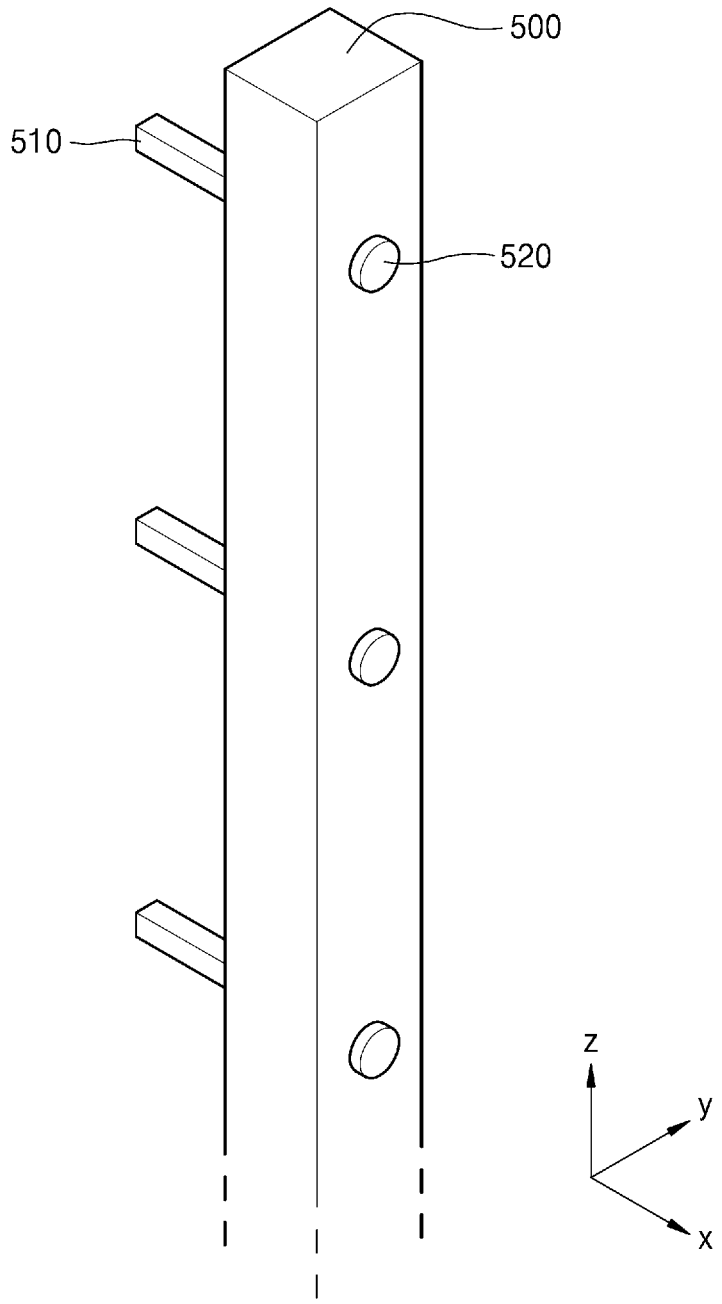
FIG. 9 is a perspective view of a driver according to an embodiment.

FIG. 8 is a perspective view of the door 300 and the driver 500 according to an embodiment, and FIG. 9 is a perspective view of the driver 500 according to an embodiment.

Referring to FIG. 8, the cassette 10 may further include the driver 500. The driver 500 may provide power for rotating the door 300. The driver 500 may be arranged on one side or two opposite sides of the housing 200 and coupled to the door 300. In the case where the size of the cassette 10 is large and thus the weight of the door 300 is large, it may be difficult to rotate the door 300 with only torque transferred by the driver 500 arranged on one side of the housing 200. That is, the driver 500 may be arranged on only one side or two opposite sides of the housing 200 depending on torque required to open and close the door 300. Hereinafter, for convenience of description, the driver 500 arranged on one side of the housing 200 is mainly described.

In an embodiment, the driver 500 may include a rotational pin 510. The rotational pin 510 is a member connected to a rotational mechanism, for example, a motor to rotate the door 300.

The rotational pin 510 may be coupled to the groove portion 311 of the pivot 310. Specifically, the shape of the rotational pin 510 may be formed to correspond to the shape of the groove portion 311. A rotational pin 510 of a driver 500 may be fit into the groove portion 311 of the pivot 310. Accordingly, when the rotational pin 510 rotates, the pivot 310 rotates, and thus, the door 300 fixedly coupled to the pivot 310 may rotate around the pivot 310.

In addition, a number of the rotational pin 510 in the driver 500 may be the same as a number of doors 300 to control the opening of each of the doors 300. In this case, the plurality of rotational pins 510 may each rotate to open and close each door 300, or rotate at the same time to open and close all doors 300. For this purpose, a manipulation button 520 may be provided to the driver 500. When the manipulation button 520 is turned on and off, the rotational pin 510 may rotate and stop. This controls the rotation of the door 300.

As shown in FIG. 8, the driver 500 may not be always coupled to the door 300. As an example, the driver 500 may remain separated from the door 300 and may be coupled to the door 300 when the door 300 needs to be opened and closed.

Figure 10:
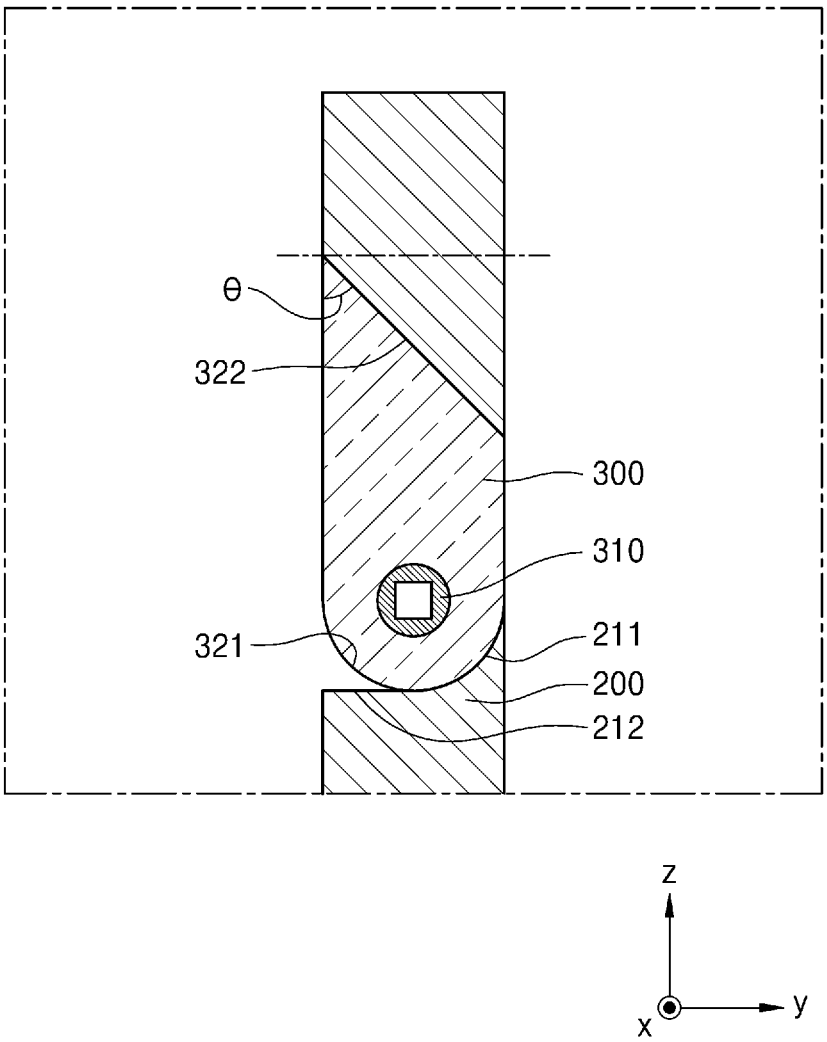
FIG. 10 is a cross-sectional view of modified embodiments of the door and the housing according to an embodiment.
Figure 11:
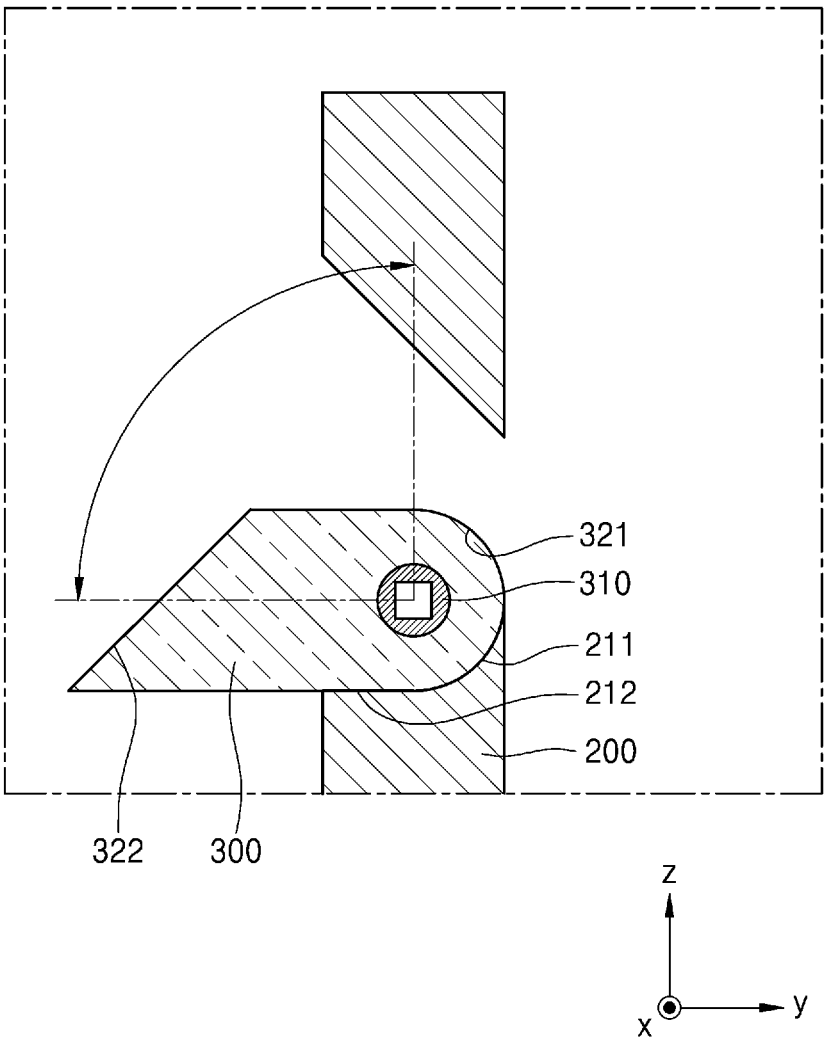
FIG. 11 is a cross-sectional view of the door of FIG. 10 that is being opened.

FIG. 10 is a cross-sectional view of modified embodiments of the door and the housing according to an embodiment and FIG. 11 is a cross-sectional view of the door of FIG. 10 that is being opened. The present embodiment is a modified embodiment of the above embodiment. The same descriptions as those of the above embodiment are omitted and differences are mainly described below.

Referring to FIG. 10, the door 300 may be arranged in the opening 210 to shield the opening 210 and connected to the housing 200. In this case, the pivot 310 may pass through the lower portion (e.g., a (−) z-direction in FIG. 10) of the door 300 horizontally. The door 300 may be opened by rotating the door 300 downward with the pivot 310 passing through the lower portion as a rotational shaft.

In an embodiment, the first side 321 may be arranged on the lower portion of the door 300, and the second side 322 may be arranged on the upper portion of the door 300. That is, as shown in FIG. 10, the door 300 and the opening 210 may be shapes in which the door 300 and the opening 210 of FIG. 6 are vertically inverted.

In this case, as shown in FIG. 10, an included angle between the second side 322 and the outer surface (the lateral surface facing the outside of the cassette main body 110) of the door 300, and between the inner side of the housing 200 and an inclined portion of the housing may have the same angle θ. That is, the surface of the door 300 facing the outside of the cassette main body 110 may be greater than the surface of the door 300 facing the inside of the cassette main body 110. As an example, as shown in FIG. 10, in the case where the door 300 rotates around the lower portion thereof, the sloped surface of the door 300 may have a downward slope from the outer surface to the inner surface. Accordingly, because the slope of the inclined portion of the housing 200 blocks the door 300 not to rotate toward the inside of the cassette main body 110 and the door 300 may rotate only toward the outside of the cassette main body 110 to be opened.

In the present embodiment, as described above, the door 300 may expose the opening 210 by rotating the rotational shaft arranged adjacent to the lower portion of the opening 210. Accordingly, the glass may be loaded to the cassette main body 110 through the opening 210 in the upper portion of the door 300 that is opened.

Figure 12:
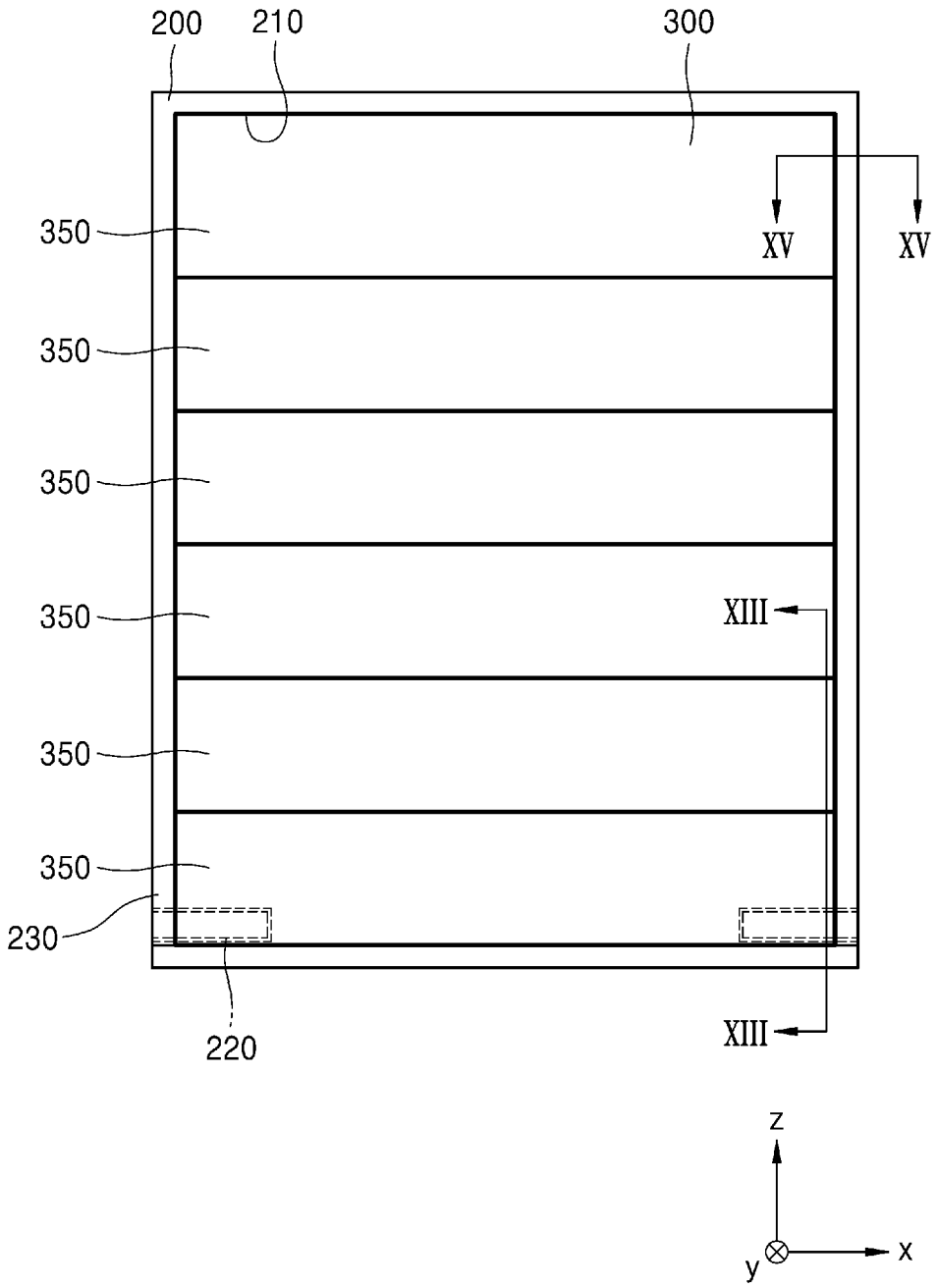
FIG. 12 is a cross-sectional view of a door of a cassette of a housing according to another embodiment.
Figure 13:
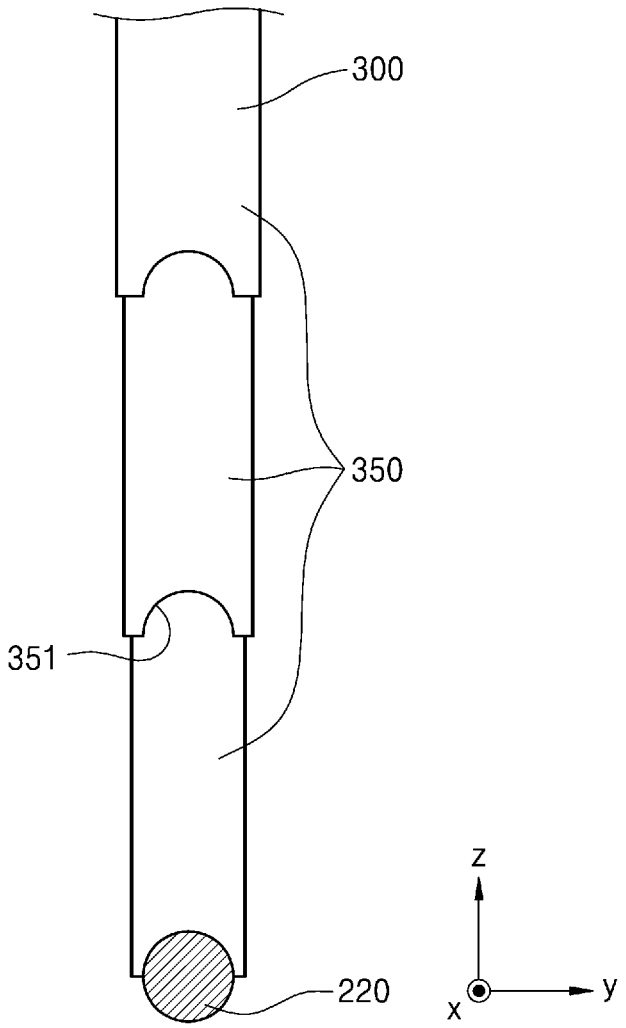
FIG. 13 is a cross-sectional view of the door and the housing of FIG. 12, taken along line XIII-XIII.

FIG. 12 is a cross-sectional view of a door and a housing of a cassette according to another embodiment, and FIG. 13 is a cross-sectional view of the door and the housing of FIG. 12, taken along line XIII-XIII. Hereinafter, differences from the above embodiments are mainly described.

Referring to FIGS. 12 and 13, the housing 200 may be arranged on at least one side of the cassette main body 110. As an example, the housing 200 may be coupled to the main body in which the opening hole 112 is formed.

The housing 200 may form a frame of an outer perimeter and include the opening 210 in the center. The opening 210 may be one opening such that the plurality of glasses 400 may enter into the cassette 10 and exit from the cassette 10.

The door 300 may be connected to the housing 200 to shield the opening 210. Specifically, the door 300 may include a plurality of bodies 350. The plurality of bodies 350 may be arranged side by side in one direction, for example, the same direction as the stacking direction (that is, the z-direction in FIG. 12) of the glass 400 in the cassette main body 110 and connected to each other. In an embodiment, the plurality of bodies 350 may be connected to each other in a way of being fitted to an adjacent body 350. Specifically, as shown in FIG. 13, the plurality of bodies 350 may be connected to each other in a way in which, starting with a body 350 fixed to the upper portion of the housing 200, the bodies 350 disposed adjacent to each other are sequentially fitted.

In an embodiment, each body 350 may have a tapered shape in which a width of the each body 350 narrows in one direction (e.g., a (−) z-direction in FIG. 12). Accordingly, the body 350 to be fitted may not be completely detached from the body 350 that is fitted.

In another embodiment, each body 350 may have a constant width. In this case, to prevent the body 350 from being detached from the body 350 disposed adjacent to the body 350, a hooking member such as a stopper may be provided to the upper portion of the body 350 to be fitted.

Hereinafter, the case where the width of each body 350 is formed in a tapered shape is mainly described.

Figure 14:
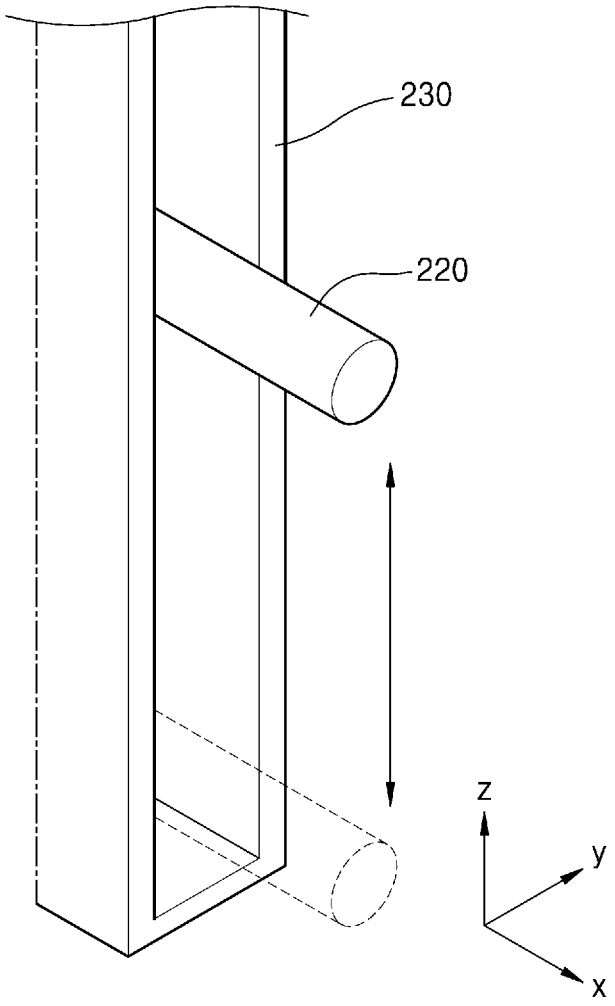
FIG. 14 is a perspective view of a protrusion and a guide rail according to an embodiment.

FIG. 14 is a perspective view of a protrusion 220 and a guide rail 230 according to an embodiment.

Referring to FIGS. 12 to 14, the housing 200 may include the protrusion 220 and the guide rail 230.

The protrusions 220 protrude toward the door 300 from two opposite sides of the housing 200. In this case, the protrusion 220 may be coupled to the door 300, specifically, one of the plurality of bodies 350. FIG. 12 shows the protrusion 220 coupled to the body 350 on the lowermost portion among the plurality of bodies 350 in an embodiment.

The protrusion 220 may move along the guide rail 230 described below in a direction in which the plurality of bodies 350 are arranged, for example, the vertical direction in FIG. 12. For this purpose, an actuator may be provided to the housing 200 to move the protrusion 220 vertically. Alternatively, the driver 500 may include an actuator and be coupled in the lower portion of the housing 200 to raise the protrusion 220 only when the door 300 needs to be opened.

Figure 15:
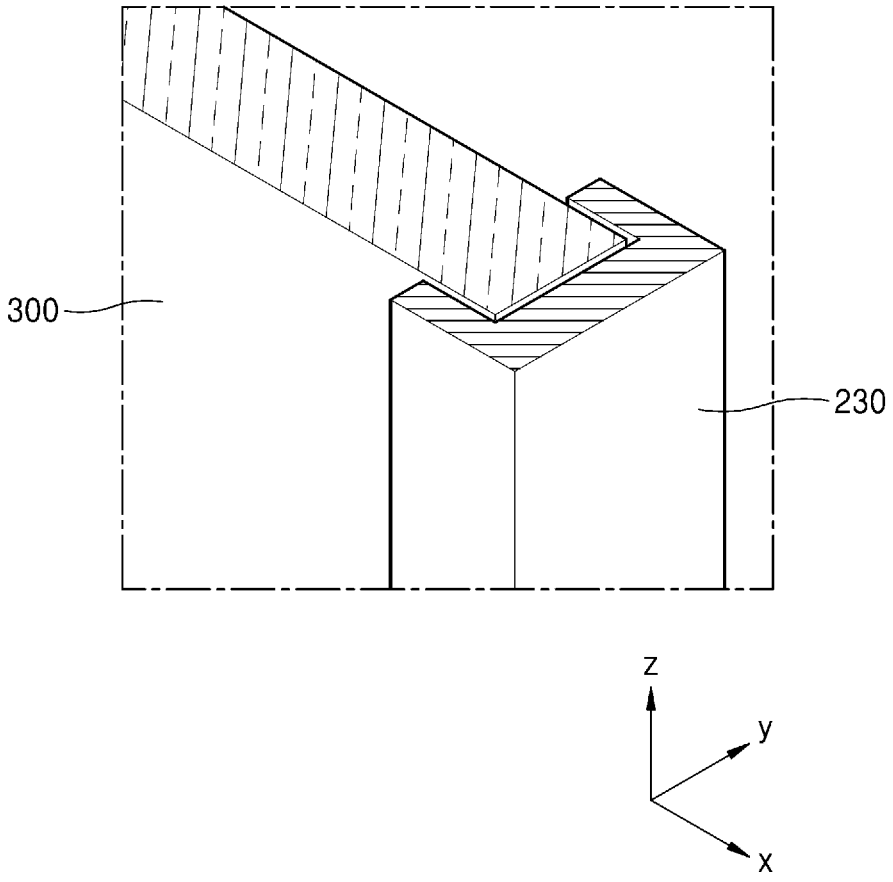
FIG. 15 is a perspective view of the door and the housing of FIG. 12, taken along line XV-XV.

FIG. 15 is a perspective view of the door 300 and the housing 200 of FIG. 12, taken along line XV-XV.

Referring to FIGS. 12 to 15, the guide rails 230 may be formed on two opposite sides (the sides in the x-direction and the (−) x-direction in FIG. 12) of the housing 200. The guide rail 230 may include a groove. The door 300 may be accommodated in the groove. Accordingly, the door 300 and the protrusion 220 connected thereto may slidably move along the guide rail 230.

Figure 16:
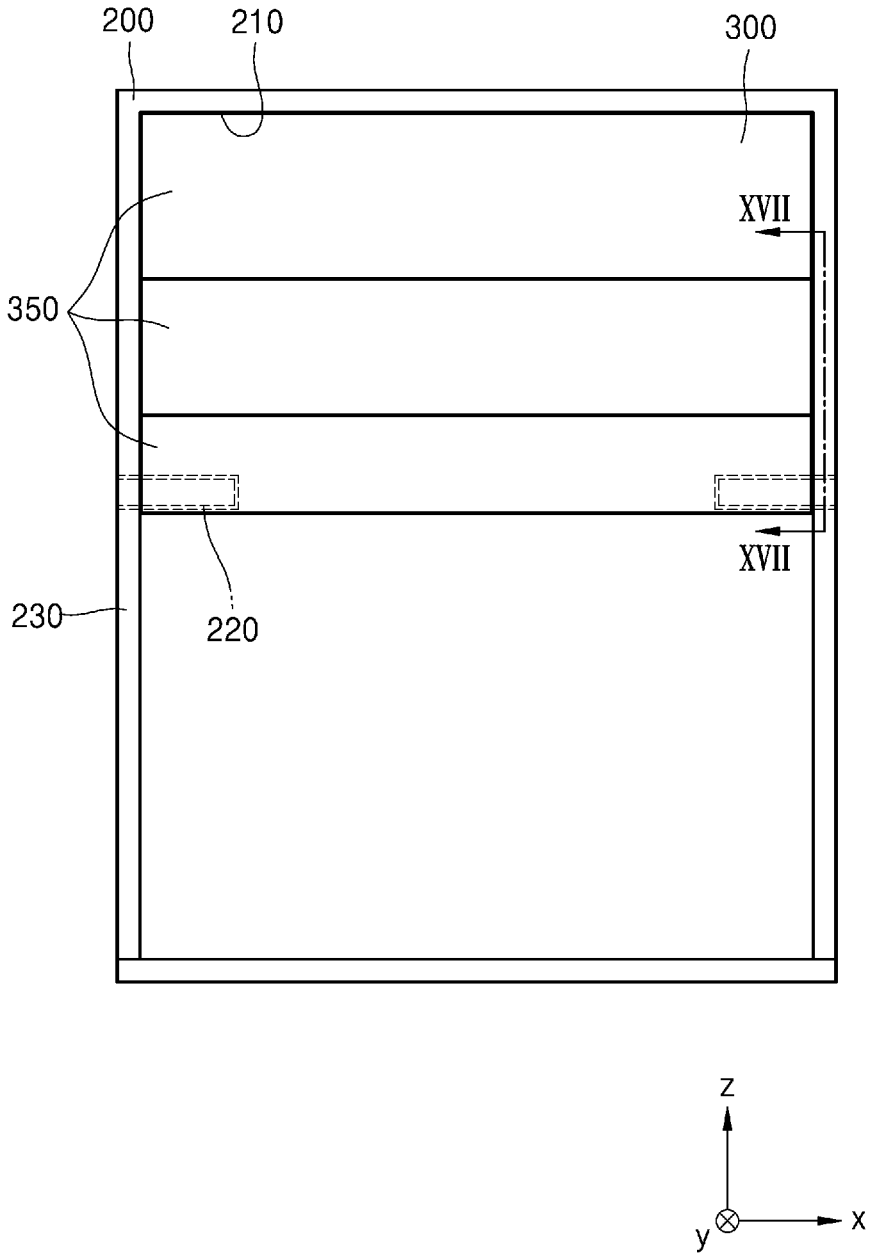
FIG. 16 is a cross-sectional view of the door of FIG. 12 that is being opened.
Figure 17:
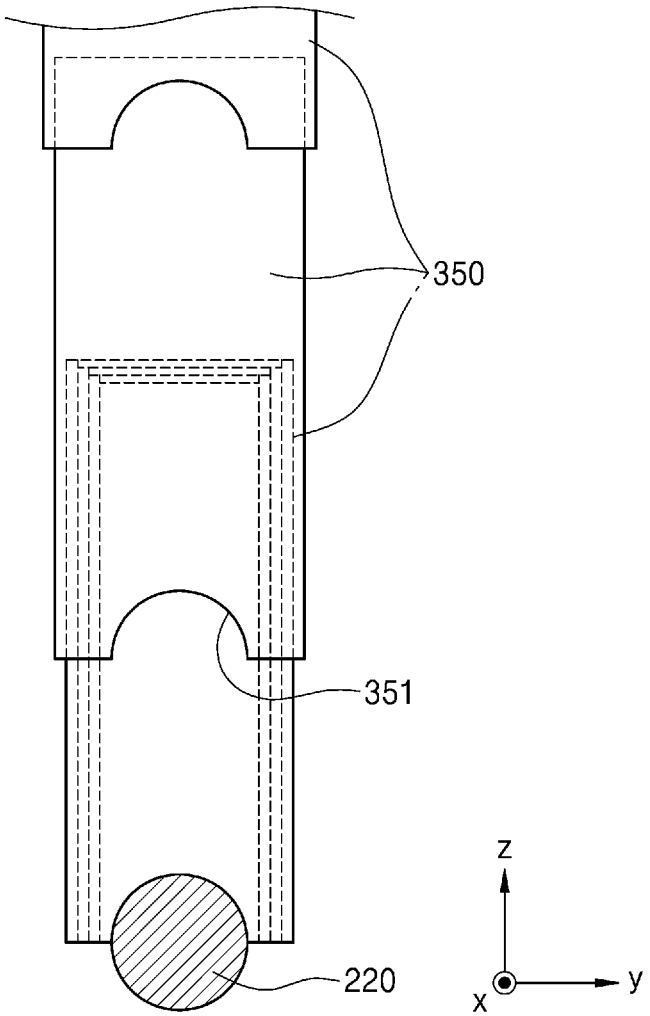
FIG. 17 is a cross-sectional view of the door of FIG. 16, taken along line XVII-XVII.

FIG. 16 is a cross-sectional view of the door 300 of FIG. 12 that is opened, and FIG. 17 is a cross-sectional view of the door 300 of FIG. 16, taken along line XVII-XVII.

Referring to FIGS. 16 and 17, as the protrusion 220 move upwards along the guide rail 230, the door 300 is opened. Specifically, as the protrusion 220 move upwards, the body 350 in the lowermost portion coupled to the protrusion 220 may be move upwards into the inside of the adjacent body 350, and the protrusion 220 may continuously push the next body 350 upwardly. The plurality of bodies 350 may be continuously move upwards to the inside of the adjacent body, and thus, the door 300 may be opened. In this case, the plurality of bodies 350 may each include an accommodating groove 351 for accommodating the protrusion 220 when the protrusion 220 move upwards.

Figure 18:
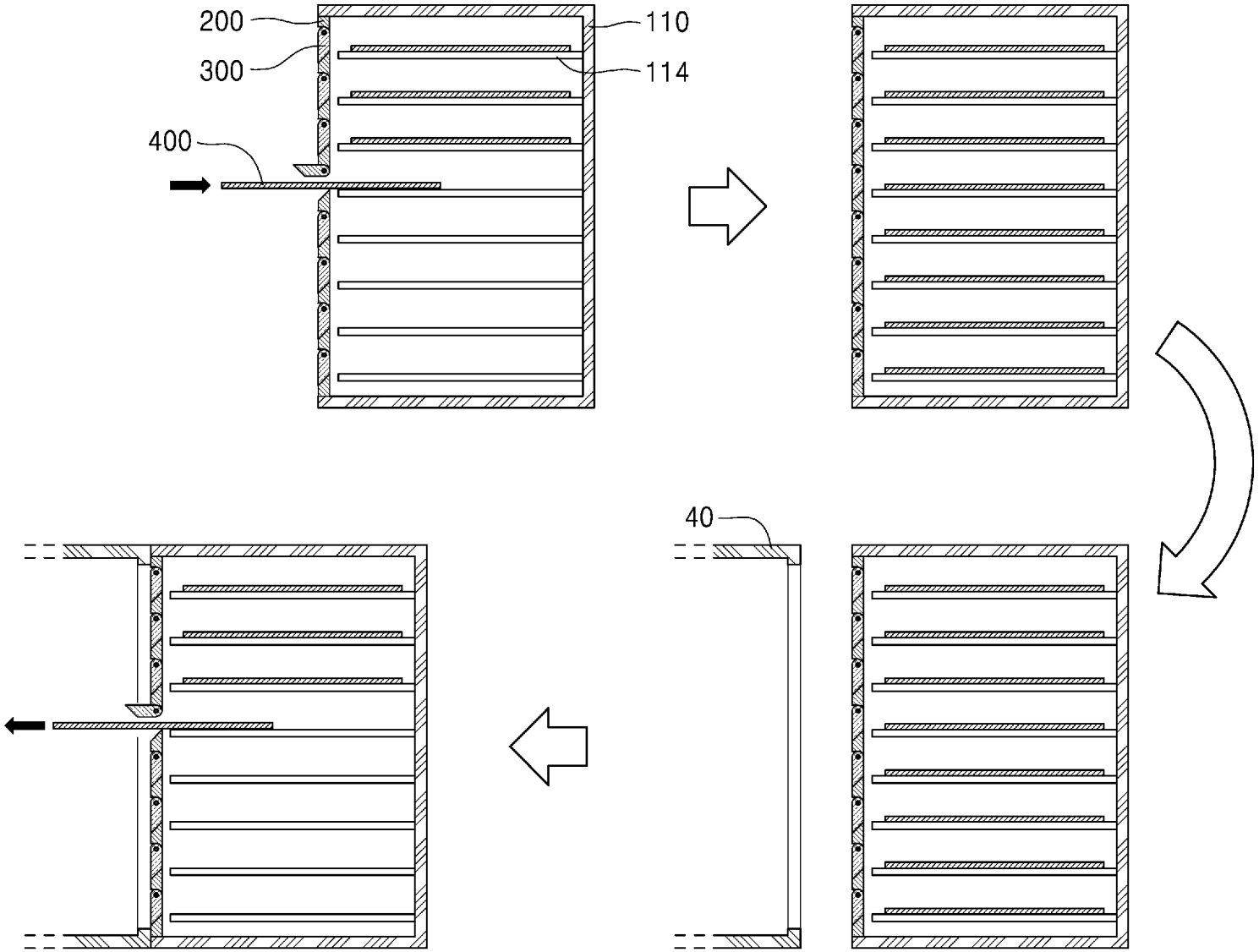
FIG. 18 is a view showing a method of manufacturing a cover window according to an embodiment.

FIG. 18 is a view showing a method of manufacturing a cover window according to an embodiment.

Referring to FIG. 18, the glass 400 may be loaded in the cassette 10 for accommodating glass in the cassette 10. In this case, the cassette 10 for accommodating glass may be the cassette 10 for accommodating glass according to the above embodiments. The glass 400 may be, for example, ultra-thin glass having a thickness of 1 mm or less. The glass 400 may be loaded into the cassette 10 through the door 300 of the cassette 10 for accommodating glass. In this case, the plurality of doors 300 may be opened one by one, and the glasses 400 may also be loaded one by one. In addition, the plurality of doors 300 may be opened when the driver 500 is temporarily coupled and transfers torque. In an embodiment, the glass 400 may be loaded into the cassette 10 for accommodating glass by a robot arm. Accordingly, an opening area of the door 300 may be reduced, and thus, inflow of external foreign materials may be reduced. In addition, because the door 300 rotates toward the outside to be opened, foreign materials of the door 300 may not be introduced to the inside of the cassette 10 for accommodating glass.

After all of the glasses 400 are loaded, the cassette 10 for accommodating glass may be moved to a cover window manufacturing stage 40 by a moving means. In this case, the cassette 10 for accommodating glass may be sealed with all of the doors 300 closed. In an embodiment, the cover window manufacturing stage 40 may be performed in a clean room maintaining a clean environment.

The cassette 10 for accommodating glass moved to the cover window manufacturing stage 40 may be docked with the cover window manufacturing stage 40 in an embodiment. Next, the door 300 may be opened according to the above description, and the glass 400 loaded in the inside of the cassette 10 may be transferred to the cover window manufacturing stage 40. In this case, like the case where the glasses 400 are loaded, the doors 300 may be opened one by one, and the glasses 400 loaded in the cassette 10 may be moved to the cover window manufacturing stage 40 one by one. However, in another embodiment, it will be understood that the plurality of doors 300 may be opened and a plurality of glasses 400 may be transferred to the cover window manufacturing stage 40 at the same time.

In an embodiment, a protection coating may be formed on the glass 400 which is transferred to the cover window manufacturing stage 40. The protection coating may be formed by using ultraviolet (UV) hardening ink.

After that, the glass 400 may be cut into a size appropriate for a display apparatus. In addition, the glass 400 may be polished and chemically strengthened to protect the glass 400 from impacts or scratches. In an embodiment, the chemical strengthening operation may include immersing the glass 400 in a chemical solution. The glass 400 may have physical properties that are more resistant to impacts by replacing sodium ions on the surface of the glass 400 with potassium ions.

The cover window may be manufactured by using the glass 400 through the above process. In addition, in the case of a flexible cover window, an operation of bending a portion of the glass 400 through a thermoforming process may be further performed.

The cassette for accommodating glass according to embodiments may be easily opened and closed while preventing inflow of foreign materials by sealing the inside thereof.

A method of loading glass in a cassette according to embodiments may easily load glass while preventing external foreign materials from being introduced to the cassette.

A method of manufacturing a cover window according to embodiments may easily manufacture a cover window having excellent quality by using the cassette.

Effects of the present disclosure are not limited to the above mentioned effects and other effects not mentioned may be clearly understood by those of ordinary skill in the art from the following claims.

It should be understood that embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from the spirit and scope as defined by the following claims.

What is claimed is:

1. A cassette for accommodating glass, comprising:

a cassette main body for accommodating a plurality of glasses;

a housing arranged on at least one side of the cassette main body and including a plurality of openings juxtaposed in one direction; and a plurality of doors configured to open and close the plurality of openings, a driver arranged on at least one side of the housing and configured to control opening of each of the plurality of doors, wherein the plurality of doors each include a groove portion in one side thereof, wherein the driver includes a rotation pin coupled to the groove portion and rotating a door connected to the rotation pin to open and close the door, wherein each end of the plurality of doors has a first sloped surface having a first sloped angle in a cross-sectional view, wherein the housing have second sloped surfaces each facing and overlapped with corresponding first sloped surface when the plurality of doors are closed, and wherein each of the second sloped surface has the same angle of slope as the first sloped surface.

2. The cassette for accommodating glass of claim 1, wherein each of the plurality of doors is configured to selectively expose each of the plurality of openings to the outside such that each of the plurality of glasses is loaded into the cassette.

3. The cassette for accommodating glass of claim 1, wherein the door is opened or closed by rotating around a rotational axis.

4. The cassette for accommodating glass of claim 3, wherein a contact surface between the door and the housing has a slope.

5. The cassette for accommodating glass of claim 3, wherein a surface of the door facing the outside of the cassette main body is greater than a surface of the door facing an inside of the cassette main body.

6. The cassette for accommodating glass of claim 3, wherein the door rotates within an angle of a preset range.

7. The cassette for accommodating glass of claim 1, wherein the door is opened by rotating the door in a direction facing the outside of the cassette main body.

8. The cassette for accommodating glass of claim 1, wherein the door includes a curved surface, and wherein the housing includes a concave curved surface corresponding to a portion of the curved surface.

* * * * *